United States Patent [19]

Anderson

[11] 4,290,502

[45] Sep. 22, 1981

[54] FOLDING STEP STOOL

[76] Inventor: John B. Anderson, 8248 Royal Gorge Dr., San Diego, Calif. 92119

[21] Appl. No.: 74,150

[22] Filed: Sep. 10, 1979

[51] Int. Cl.[3] ..... A47C 13/00

[52] U.S. Cl. ..... 182/33; 182/125; 297/59

[58] Field of Search ..... 182/124, 125, 126, 15, 182/33, 97, 156, 159, 106; 297/59, 58, 55

[56] References Cited

U.S. PATENT DOCUMENTS

| | | | |
|---|---|---|---|
| 1,667,406 | 4/1928 | Wilkinson | 297/59 |
| 2,952,301 | 9/1960 | Schlaak | 182/156 |
| 3,136,386 | 6/1964 | Horvath | 182/15 |
| 3,997,024 | 12/1976 | Fredricks | 182/15 |

*Primary Examiner*—Reinaldo P. Machado
*Attorney, Agent, or Firm*—Brown & Martin

[57] ABSTRACT

When folded the step stool is self standing and has a narrow width to permit the step stool to be stored in otherwise unusable spaces. When the legs are extended, a stable triangular support for two or more steps is provided. The vertical uprights of the device carry a handgrip positioned well above the level of the highest step to be useful when a person is on the highest step and during ascent and descent of the steps.

10 Claims, 3 Drawing Figures

FOLDING STEP STOOL

BACKGROUND OF THE INVENTION

Step stools are commonly employed for both household and industrial purposes to reach articles or otherwise perform work at a height above the normal safe reach. According to the prior art, such step stools may be a fixed configuration having one or more steps. Such fixed step stools are bulky and are not easily stored when not in use. No handgrip is provided above the level of the top step to stabilize the person utilizing the step stool when ascending, descending and reaching from the top step of the step stool.

Folding step stools are also known. According to one popular design, a step stool incorporates two folding steps carried between a first U-shaped member and pivoting legs. When in the extended position, both U-shaped member and legs are at an angle with respect to the floor and pivotally engage the floor with rubber crutch tip terminations. Such step stools are not self-supporting when retracted. The U-shaped member does form a crosspiece above the level of the highest step; however, the crosspiece is generally no more than one step-to-step vertical distance above the highest step and therefore is not useful as a handgrip when ascending, descending or standing upon the highest step. Because both the U-shaped member and the legs are at an angle, it is not possible to move such a step stool directly against a vertical surface and therefore the person utilizing the step stool must lean toward the vertical surface to reach, requiring a precarious balancing.

It is therefore desirable to have a step stool which combines the features of foldability with an effective handgrip. Such a step stool is particularly desirable where it may be utilized closely against vertical surfaces, and is self-supporting and compact in the folded position.

SUMMARY OF THE INVENTION

According to an exemplary embodiment of the invention the disadvantages of the prior art devices are overcome in a folding step stool that utilizes a normally vertical frame that mounts legs which pivot between extended and retracted (folded) positions. The legs carry one or more steps which retract with the legs to produce a narrow folded width so that the device may be stowed conveniently out of the way when not in use. The retraction of the leg and steps is accomplished by pivoting the upper extreme of the legs in a dowel and slot combination within the frame uprights. A platform step is pivoted along one edge on the legs and along the other edge on the frame to provide a substantial horizontal surface in the extended position of the legs and to retract with the legs to lie substantially in the plane of the frame. The lower terminus of the legs preferably incorporates a base having a horizontal floor engaging lower surface and extending between the uprights. The base thereby serves both as a floor supporting surface when extended and as a stand for the stool when the legs are retracted.

When the legs are in the extended position, the highest step (preferably the platform step) is substantially below the highest vertical extent of the frame uprights. At the upper terminus of the frame uprights, a handgrip is provided so that the handgrip may be grasped by a person ascending the stool to the highest step without the person being forced to bend over excessively. To be effective for this purpose, the handgrip is placed above the level of the highest step by a minimum of twice the step-to-step distance. For this purpose, the step-to-step distance is defined as the distance between steps, or in the case of a single step stool, the distance between the floor and the step.

All of the pivoting joints of the device may be made by utilizing a dowel and socket configuration which avoids stressing screws or other fasteners by the load carried on the step stool, thus permitting a lightweight structure that can safely carry a substantial load.

It is therefore an object of the invention to provide a new and improved folding step stool. The step stool may be made light in weight and out of relatively inexpensive materials, and yet have sufficient strength to safely support a person ascending, working from, and descending the step stool. When not in use, the step stool may be folded to a relatively narrow widtgh to be stowed in a narrow space such as is often available between a refrigerator and an adjoining wall. The handgrip is both a safety aid and increases the confidence of persons utilizing the stool. The frame members remain vertical when the stool is in the extended position so that the step platform may be moved very close to a vertical surface. Other objects and many attendant advantages of the invention will become more apparent upon reading of the following detailed description together with the drawings, in which like reference numerals refer to like parts throughout and in which:

DETAILED DESCRIPTION OF THE DRAWINGS

Figure 1:
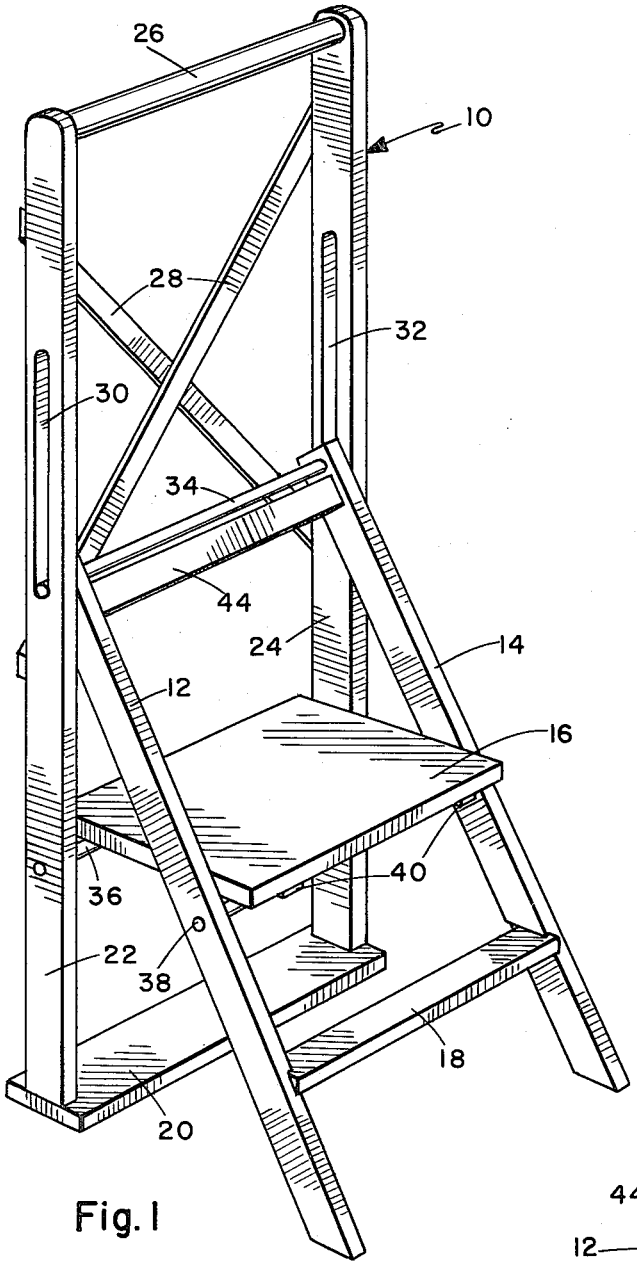
FIG. 1 is a perspective view of the step stool in the extended position.

Referring to the drawings, there is illustrated a frame 10 having a floor engaging lower terminus in the form of a base 20. The base provides a substantial horizontal surface for engagement with the floor and a steady base for the step stool in both the extended and the retracted positions. Uprights 22 and 24 extend vertically from the base and support the folding step legs and handgrip as is described more fully hereinafter. A handgrip 26 is secured between the uprights 22 and 24 at their upper terminus and forms an additional frame member, stiffening the frame in addition to functioning as a handgrip for a person ascending and descending the stool. The handgrip is 28 inches above the highest step, step 16. Additional stiffening and longitudinal rigidity for the frame is provided by cross braces 28. A pair of slots are located in the rear one-half of the width of the upright (the side opposite the side from which the legs extend). The slots extend vertically a sufficient distance to accommodate the travel of the upper portion of the legs during folding as described hereinafter.

A dowel 34 is carried in the slots 30 and 32 for a combination of translation and rotation during the folding action. The frame 10 also carries a dowel 36 which is received in bores through the uprights 22 and 24 positioned in the rearward one-half of the horizontal width of the uprights. A pair of legs 12 and 14 are secured to the uprights by the dowel 34 being received through the upper extremities of the legs. A platform step 16 is secured to the uprights in a pivoting connection to the dowel 36. The legs 12 and 14 are braced by cross brace 44, mounted below the dowel 34, and the step brace 18 received in slots in the legs 12 and 14 and positioned to be horizontal when the legs are extended. Dowel 38 extends between the legs 12 and 14 intermediate the step brace 18 and cross brace 44. The platform-step 16 is carried pivotally on the legs by dowels 38. The platform-step 16 is horizontal in the extended position of the legs. Loads on the platform-step 16 are transmitted to the dowels 36 and 38 near the point where the dowels enter the legs and uprights, respectively, so that relatively low bending forces are created. The force is concentrated near the ends of the dowels through the use of strips 40 which also serve to mount the pivot brackets 42.

Figure 2:
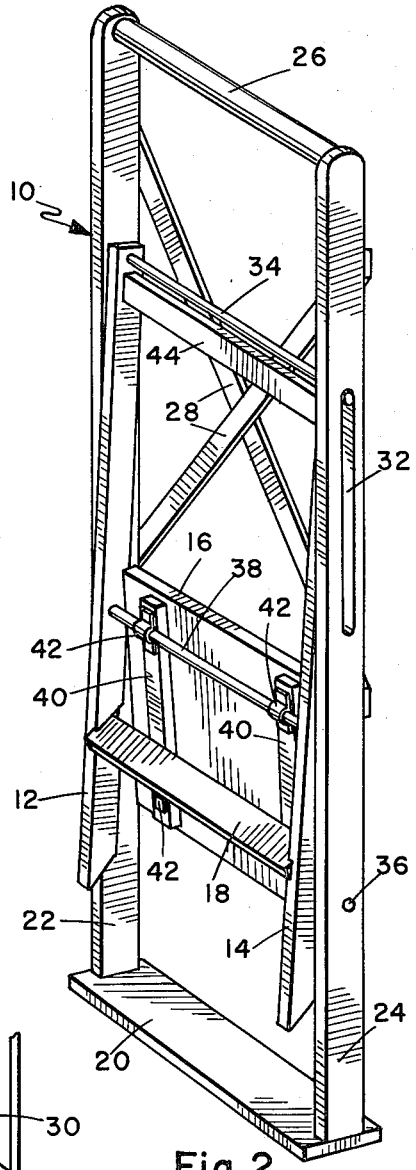
FIG. 2 is a perspective view of the structure in the retracted position.
Figure 3:
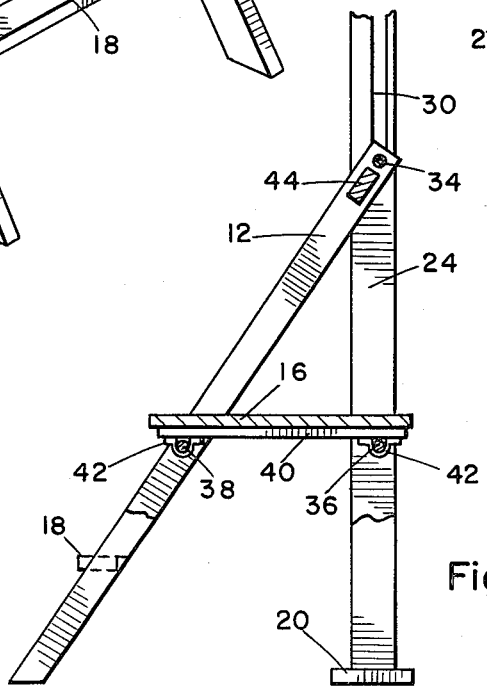
FIG. 3 is a elevational view of the step stool in the extended position, with portions cut away.

Referring to FIG. 2, the folded or retracted position of the step stool is illustrated. When folded, the dowel 34 has been translated from the position at the lower extremities of slots 30 and 32 to a position at the upper extremities of slots 30 and 32. The legs 12 and 14 are limited in their folding action by contact with the dowel 36. However, by placement of the dowel 36 in the rearward one-half of the width of uprights 22 and 24, the folding actions proceed to the point where the lower extremities of the legs lie within the vertical projection of the base 20. Since the slots 30 and 32 are also within the rearward one-half, the center of gravity of the entire combination lies above the base 20 so that the step stool will stand by itself without the need for leaning against any vertical surface. The positioning of the center of gravity is also favorably affected by the use of the strips 40 which place the seat further within the vertical projection of base 20 when the legs are folded.

The step stool may be made in its principal components out of readily available wood materials and still produce good strength with adequate safety factors. The triangular form assumed by the leg-upright combination in the extended position is responsible for good basic strength and stability against tilting under load. Dowels received in bores are utilized at all points of vertical load transfer (shear) so that the vertical load does not have to be transmitted through fasteners which might loosen in use. Accordingly, the basic frame and step leg members may be made of clear pine lumber. Suitable dimensions for the uprights are $\frac{7}{8}\times 1\frac{1}{2}$ inch and for the legs $\frac{7}{8}\times 1\frac{1}{4}$ inch. The load bearing dowels are selected of harder materials. Birch dowels of $\frac{1}{2}$ inch in diameter are preferred for the step dowels, and $\frac{3}{8}$ inch in diameter for the dowel 34. A step stool with these materials has been tested with a 700 pound load on the platform step.

OPERATION

In use, with the legs extended, the step stool may be placed against a vertical wall. Because the uprights themselves are vertical, the step 16 is very close to the vertical wall, eliminating the need for the person using the step stool to lean toward the wall to reach objects. In ascending and descending the step stool and reaching from the platform step, the person may utilize the handgrip 26 which is placed at a height sufficiently above the platform step 16, that the person does not have to bend significantly when holding the grip even when standing upright on the top step. At the same time, the handgrip 26 may be utilized as a brace against which the upper legs press while performing useful work with both hands. The step brace 18 is received in slots in the legs 12 and 14, so it can carry vertical loads. Step brace 18 is particularly useful for elderly persons who may not be able to easily step to the level of the platform step without an intermediate step.

When the use of the step stool is complete, it may be easily retracted by lifting on the cross brace 44, which causes a lifting and pivoting of legs 12 and 14 and a pivoting of the platform-step 16 to the retracted position illustrated. When retracted, the step stool is stable on its base 20, and is self-latching in the retracted position due to the weight and positioning of the step brace 16 and strips 42 counterbalancing the weight and orientation of the legs 12 and 14. The narrow width of the folded configuration makes it possible to slide the step stool into an otherwise unused space, such as the narrow space between a refrigerator and an adjacent wall.

Having described my invention, I now claim:

1. A folding step stool comprising:

a frame having a floor engaging terminus and having at least two substantially vertical uprights, plurality of legs been carried on said frame by mounting means for movement of said legs between extended and retracted positions, said legs comprising means in said extended position for extending into engagement with a horizontal floor and for coacting with said frame lower terminus to support said uprights substantially vertically, said legs, in said retracted position being adapted to lie closely against said frame, at least one platform-step pivotally mounted adjacent a first edge on said legs and pivotal mounted adjacent the opposite edge on said upright, said platform step lying entirely within the vertical projection of a planar area defined by said floor engaging terminus and the bottom surface of said legs in said extended position, at least one additional step carried by said legs and lying within the vertical projection of said area but extending beyond the vertical projection of a area defined by said step platform when said legs are in said extended position.

2. A step stool according to claim 1, wherein:

said lower terminus comprises a base having substantially planar floor engaging surface.

3. A step stool according to claim 2, wherein:

said legs, in the retracted position, lie within the vertical projection of said base.

4. A step stool according to claim 1, further comprising:

a slot in said uprights, said mounting means comprises a pivot received in said slot for combined rotation and translation along said slot.

5. A step stool according to claim 4, wherein:

said slot is in the half of the width of said uprights opposite the side of said frame from which said legs extend.

6. A step stool according to claim 1, wherein:

the pivotal mounting of said platform-step on said uprights comprises a dowel member received in bores in said uprights.

7. A step stool according to claim 6, wherein:

said bores are in the half of the width of said uprights opposite the side of said frame from which said legs extend.

8. A step stool according to claim 1, wherein:

said platform-step is the highest step carried by said legs, said uprights extend substantially above the level of said platform step, and said frame includes a handgrip forming a part of said frame and secured to said uprights substantially above the level of said platform step.

9. A step stool according to claim 8, wherein:

said handgrip is above said platform by a distance of at least twice the step-to-step vertical distance.

10. A step stool according to claim 8, wherein:

said handgrip is substantially 28 inches above said platform step.

* * * * *